US006701544B2

(12) United States Patent
Heimbrock

(10) Patent No.: US 6,701,544 B2
(45) Date of Patent: Mar. 9, 2004

(54) PATIENT TRANSFER APPARATUS

(75) Inventor: Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 10/267,386

(22) Filed: Oct. 9, 2002

(65) Prior Publication Data

US 2003/0070226 A1 Apr. 17, 2003

Related U.S. Application Data

(62) Division of application No. 09/591,176, filed on Jun. 9, 2000, now Pat. No. 6,467,106.

(60) Provisional application No. 60/139,143, filed on Jun. 14, 1999.

(51) Int. Cl.[7] ..... A61G 7/08; A47C 27/08

(52) U.S. Cl. ..... 5/81.1 R; 5/81.1 HS; 5/926; 5/709

(58) Field of Search ..... 5/81.1 R, 81.1 HS, 5/644, 706, 709, 714, 715, 652.1, 652.2, 654, 655.3, 925, 926, 420, 655.9, 740, 953

(56) References Cited

U.S. PATENT DOCUMENTS

| | | | | |
|---|---|---|---|---|
| 435,058 A | | 8/1890 | Freund | 4/455 |
| 611,377 A | | 6/1898 | Davis | 297/200 |
| 2,671,226 A | | 3/1954 | Lychenheim | 5/655.3 X |
| 2,689,812 A | | 9/1954 | Mollica et al. | 156/281 |
| 2,718,014 A | | 9/1955 | Mizrach et al. | 4/506 |
| 2,918,681 A | | 12/1959 | Davis | 5/81.1 C |
| 3,125,377 A | | 3/1964 | Bridges | 297/462 |
| 3,416,626 A | | 12/1968 | Nagamatsu | 180/124 |
| 3,667,073 A | | 6/1972 | Renfoe | 5/81.1 R |
| 3,769,642 A | | 11/1973 | Warman | 5/925 X |
| 4,051,565 A | | 10/1977 | Berge | 5/81.1 C |
| 4,272,856 A | | 6/1981 | Wegener et al. | 5/81.1 T |
| 4,417,639 A | | 11/1983 | Wegener | 180/125 |
| 4,517,690 A | | 5/1985 | Wegener | 5/81.1 R |
| 4,528,704 A | | 7/1985 | Wegener et al. | 5/81.1 R |
| 4,528,705 A | | 7/1985 | Greenawalt | 5/644 |
| 4,547,919 A | | 10/1985 | Wang | 5/706 X |
| 4,686,719 A | | 8/1987 | Johnson et al. | 5/81.1 R |
| 4,944,053 A | | 7/1990 | Smith | 5/81.1 C |
| 5,003,653 A | | 4/1991 | Mar | 5/654 |
| 5,067,189 A | | 11/1991 | Weedling et al. | 5/81.1 R |
| 5,271,110 A | * | 12/1993 | Newman | 5/81.1 R |
| 5,287,577 A | * | 2/1994 | Ackroyd | 5/644 |
| 5,303,977 A | | 4/1994 | Sereboff | 297/230.1 |
| RE35,468 E | * | 3/1997 | Newman | 5/81.1 R |
| 5,860,174 A | | 1/1999 | Failor | 5/81.1 HS |
| 5,996,133 A | | 12/1999 | Fletcher | 4/239 |
| 6,073,291 A | * | 6/2000 | Davis | 5/81.1 R |
| 6,089,668 A | | 7/2000 | Peterson | 5/654 X |
| 6,467,291 B1 | * | 10/2002 | Takano et al. | 5/81.1 HS |
| 2003/0070226 A1 | * | 4/2003 | Heimbrock | 5/81.1 R |
| 2003/0159212 A1 | * | 8/2003 | Patrick et al. | 5/81.1 R |

FOREIGN PATENT DOCUMENTS

| | | | | |
|---|---|---|---|---|
| GB | 2159047 A | 11/1985 | | 5/81.1 HS |

* cited by examiner

*Primary Examiner*—Robert G. Santos
(74) *Attorney, Agent, or Firm*—Barnes & Thornburg

(57) ABSTRACT

According to the present invention, a patient transfer device includes an elongated foam pad having a fluid impervious enclosure. The foam pad is configured to be placed under the patient on a first support surface, and extends along at least a portion of the patient's body. The foam pad defines a fluid chamber to receive fluid under pressure. The fluid chamber has a bottom wall facing the first support surface, and including perforations for expelling fluid against the first support surface to provide a fluid bearing to facilitate moving the foam pad and the patient supported thereon from the first support surface to an adjacent second support surface.

25 Claims, 8 Drawing Sheets

150
152
154
156
160
162
164
166
168
170
172
174
176
178
180
8

PATIENT TRANSFER APPARATUS

This is a divisional application of a copending U.S. patent application Ser. No. 09/591,176, filed on Jun. 9, 2000, now U.S. Pat. No. 6,467,106, and entitled "PATIENT TRANSFER APPARATUS", which claims the benefit of U.S. Provisional Patent Application Serial No. 60/139,143 , filed on Jun. 14, 1999, and entitled "RESIDENT TRANSFER APPARATUS".

BACKGROUND AND SUMMARY OF THE INVENTION

The present invention relates to a patient transfer apparatus to facilitate transfer of less mobile and totally immobile patients from one support surface to another adjacent support surface. Several devices exist for the purpose of transferring less mobile and totally immobile patients from one support surface, such as a stretcher, to another adjacent support surface, such as a hospital bed in a medical facility—such as a nursing home or a hospital. One such patient transfer device is disclosed in the U.S. Pat. No. 6,012,183, entitled "Patient Transfer Apparatus", and assigned to the same assignee as the present application, which is incorporated herein by reference. The therein-disclosed device includes a sheet of material formed as a continuous loop having a low-friction inner surface so that when placed under the patient, two slick surfaces slide against each other reducing the coefficient of friction and making it easier to transfer the patient. The device includes a plurality of spaced-apart handles around the outer surface of the sheet to enable the caregiver to roll the sheet of material over itself toward the second support surface to transfer the patient from the first support surface to the second support surface.

Another such device for moving less mobile and totally immobile patients or patients is illustratively disclosed in the U.S. Pat. No. 5,067,189, issued to Weedling et al. and entitled "Air Chamber Type Patient Mover Air Pallet With Multiple Control Features". The air pallet-type patient mover of Weedling et al. includes a thin flexible bottom sheet for defining an air chamber, with the bottom sheet having pinhole-type perforations through which air escapes under pressure to create an air bearing between the bottom sheet and the underlying support surface to facilitate transfer of patients.

According to the present invention, a patient transfer device includes an elongated pad configured to be placed under the patient on a first support surface, and extending along at least a portion of the patient's body. The pad includes a fluid chamber to receive fluid under pressure. The fluid chamber includes a bottom wall facing the first support surface, and having perforations for releasing the fluid from the chamber against the first support surface to provide a fluid bearing to facilitate moving the pad and the patient supported thereon from the first support surface to an adjacent second support surface.

According to another embodiment of the present invention, a patient transfer device includes an elongated foam pad having a fluid impervious enclosure. The foam pad is configured to be placed under the patient on a first support surface, and extends along at least a portion of the patient's body. The foam pad defines a fluid chamber to receive fluid under pressure. The fluid chamber has a bottom wall facing the first support surface, and including perforations for releasing fluid from the chamber against the first support surface to provide a fluid bearing to facilitate moving the foam pad and the patient supported thereon from the first support surface to an adjacent second support surface.

According to still another embodiment of the present invention, a patient transfer device includes a pair of elongated, laterally spaced apart tubes of material coupled to each other. Each tube is configured to be placed longitudinally under the patient on a first support surface, and extends along at least a portion of the patient's body. Each tube is made of sheet of material having an inside surface of relatively low friction and an outside surface of relatively high friction. Each tube is flattened when placed under a patient to have an upper run of the relatively low friction surface facing downwardly to engage a lower run of the relatively low friction surface facing upwardly such that the upper and lower runs can slide smoothly transversely as the patient is moved from the first support surface to an adjacent second support surface. The tubes are configured to be positioned on opposite sides of the first support surface such that one of the tubes provides movement of the patient to and from one side of the first support surface and such that other of the tubes provides movement of the patient to and from the other side of the first support surface.

According to a further embodiment of the present invention, a patient transfer device includes an elongated tube configured to be placed longitudinally under the patient on a first support surface and extending along at least a portion of the patient's body. The tube is flattened to have an upper run and a lower run in contact with each other. The tube has a wall structure providing a plurality of fluid chambers to receive fluid under pressure. The wall structure includes perforations opening downwardly from the upper run and upwardly from the lower run to expel fluid and provide a fluid bearing in the space between the runs to facilitate transverse movement of the upper run relative to the lower run to transport a patient from the first support surface to an adjacent second support surface.

According to a still further embodiment of the present invention, a transfer device includes a foam pad having a fluid impervious enclosure. The pad is folded over itself to form an elongated tube. The tube is flattened when placed under the patient on a first support surface to form an upper run and a lower run in contact with each other. The foam pad defines a fluid chamber to receive fluid under pressure. The fluid chamber includes a wall structure with perforations opening downwardly from the upper run and upwardly from the lower run to expel fluid and provide a fluid bearing in the space between the runs to facilitate transverse movement of the upper run relative to the lower run for movement of the patient from the first support surface to an adjacent second support surface.

According to still another embodiment of the present invention, a patient transfer device includes a plurality of elongated laterally spaced apart bladders arranged to be placed under the patient on a first support surface and a rolling sheet to be disposed between the patient and the bladders. The bladders are separately and sequentially inflatable to tilt and move the patient transversely from the first support surface to an adjacent second support surface.

According to a further embodiment of the present invention, a patient transfer device includes a pad having a fluid chamber to receive fluid under pressure, a blower configured to be coupled to the pad for pumping pressurized fluid into the fluid chamber and a pouch for supporting the blower. The pouch has a first side coupled to the pad and a second side coupled to the blower to allow the blower to be positioned on either side of the pad.

Additional features and advantages of the present invention will become apparent upon consideration of the following description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
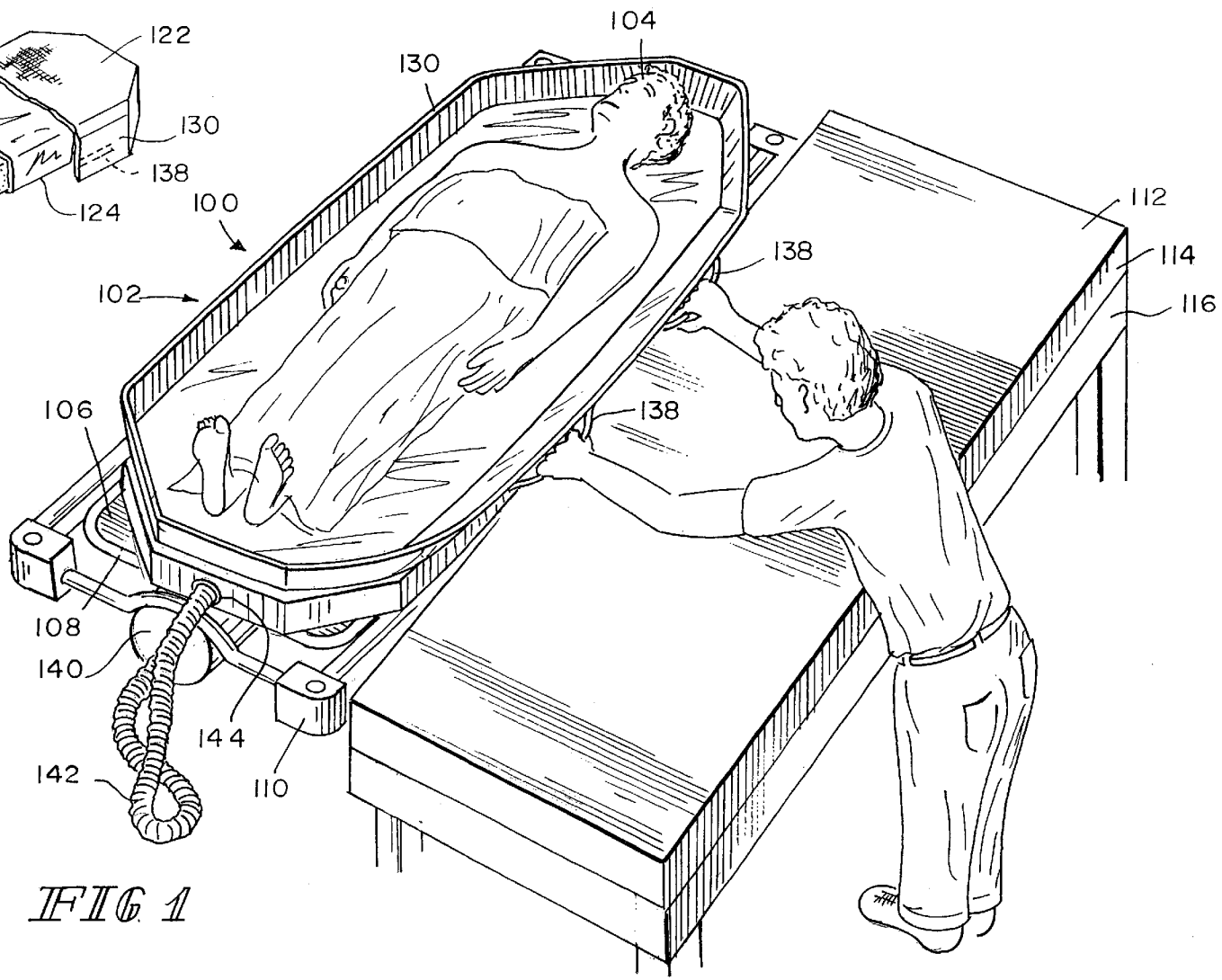
FIG. 1 shows a perspective view of a first embodiment of a patient transfer apparatus comprising a laminated topper pad coupled to an air blower and having pinhole-type perforations on the bottom side thereof to produce an air bearing between the foam pad and the underlying support surface.
Figure 2:
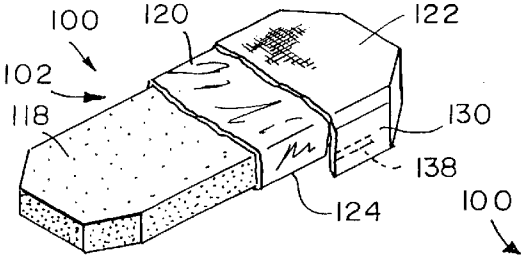
FIG. 2 shows a perspective view, partly broken away, of the laminated topper pad of FIG. 1 including a porous foam pad encapsulated in a lamination and enclosed in a protective stain-resistant fabric cover, FIG. 2 further showing a flap sewn to the protective cover around the entire perimeter of the topper pad.

Referring to FIGS. 1–6, a patient transfer apparatus 100 in accordance with the present invention comprises a mattress topper pad 102 for supporting a patient 104. The topper pad 102 is supported on a support surface 106 of a mattress 108 lying on a stretcher 110. The topper pad 102 is suitable for transferring a patient from a first support surface—such as the support surface 106 of the mattress 108, to a second support surface—such as a support surface 112 of a mattress 114 supported on a hospital bed 116. As best seen in FIG. 2, the mattress topper pad 102 includes a porous foam pad 118 encased in a lamination 120 which is air impervious. The laminated topper pad 102 may, in turn, be enclosed in a protective stain-resistant fabric cover 122. An air pump or blower 140 is coupled to one end of a fabric hose 142. The other end of the fabric hose 142 is inserted into an opening 144 in the topper pad 102 near its foot end. The outside perimeter of the hose 142 is sealed to the lamination 120 to form an air tight joint. Any suitable technique may be used for sealing the outer perimeter of the hose 142 to the lamination 120, such as RF or ultrasound welding, heat sealing, etc. The blower 140 may be either mounted on the stretcher 110 or supported on the floor next to the stretcher 110. The blower 140 pumps high volume of low pressure air (e.g., 300 CFM at 1 PSI) into the topper pad 102.

Figure 4:
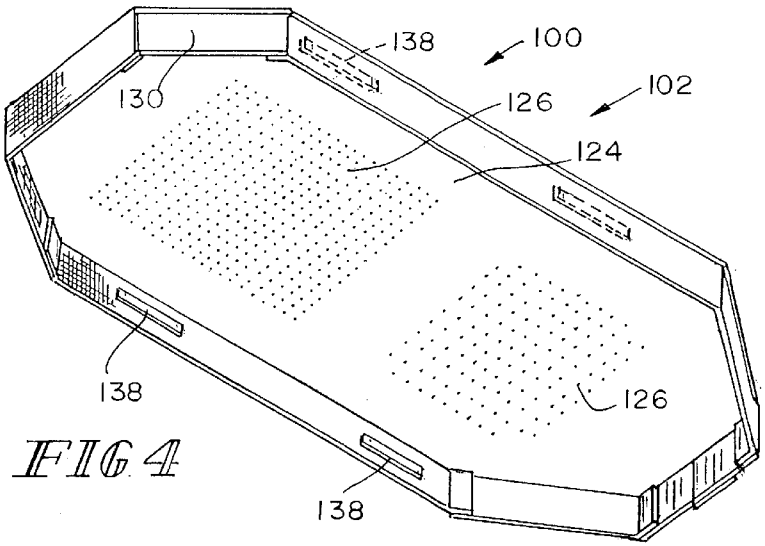
FIG. 4 is also a bottom view similar to FIG. 3, except that the cut-away corner portions of the flap are sewn to form a skirt that hangs down.
Figure 3:
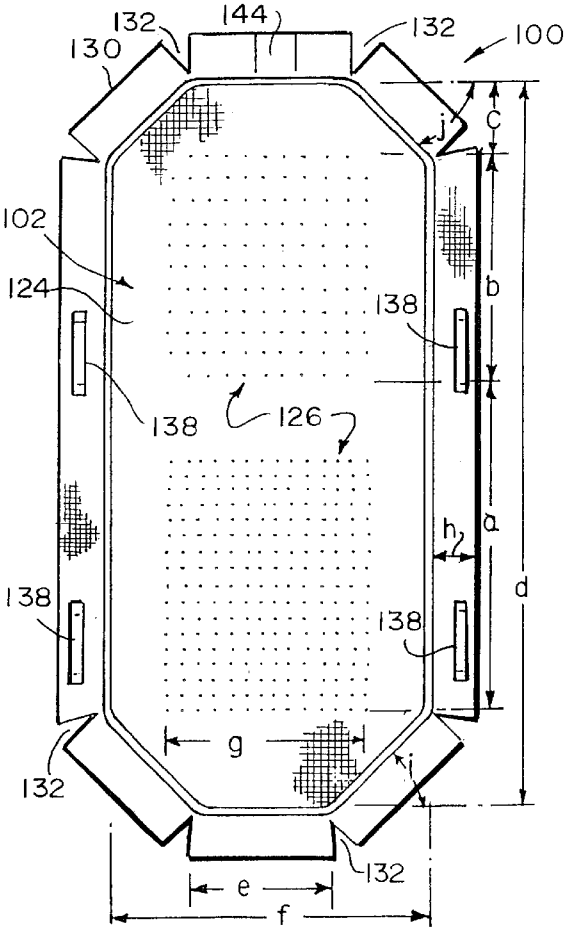
FIG. 3 is a bottom view of the topper pad of FIGS. 1 and 2, with corner portions cut away, FIG. 3 further showing pinhole-type perforations in the bottom surface of the topper pad through which air is expelled to form an air bearing between the pad and a support surface and a plurality of handle loops secured to the inside surface of the flap.

As shown in FIGS. 3 and 4, which show bottom views of the topper pad 102, a bottom surface 124 of the topper pad 102 facing the support surface 106 of the mattress 108 includes a plurality of pinhole-type perforations 126 (about 0.03 inch diameter) through which pressurized air escapes to produce an air bearing between the topper pad 102 and the mattress 108. The pinhole-type perforations 126 are arranged in a grid form as shown in FIGS. 3 and 4. Low pressure air escaping through the pinhole-type perforations 126 in the bottom surface 124 of the laminated topper pad 102 creates a floating air pallet, similar to a hovercraft. The foam pad 118 is preferably made from a very light density foam (i.e., an average indentation load deflection or ILD of 12) for easy air flow through the topper pad 102. Since most of the weight of a patient is concentrated in the torso area, the pinhole-type perforations 126 may have a higher density in the area of the topper pad 102 defining a footprint of a patient's torso, as illustrated in FIGS. 3 and 4. For example, the spacing between the pinhole-type perforations 126 in the torso area (about 16 inches wide and 37 inches long) is about ½ inch, whereas the spacing between the pinhole-type perforations 126 in the foot area (about 16 inches wide and 22 inches long) is about 1.0 inch.

Figure 5:
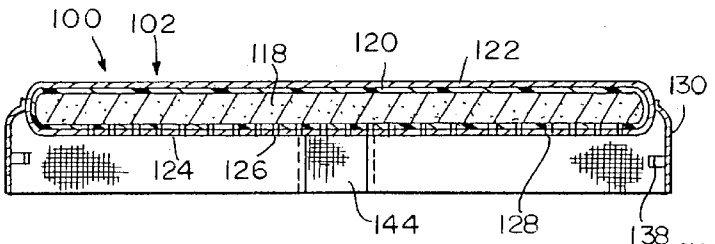
FIG. 5 shows a sectional view of the topper pad including the foam pad, lamination, protective cover and flap.
Figure 6:
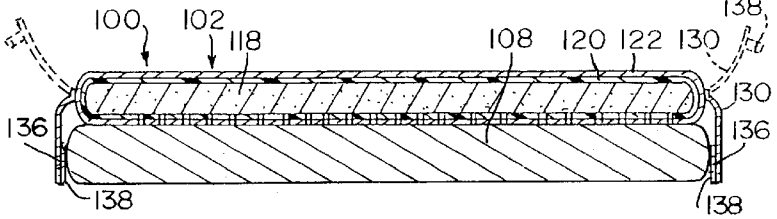
FIG. 6 is a sectional view of the topper pad similar to FIG. 5, except that the topper pad is shown resting on a mattress.

A flap 130 is secured to the protective cover 122 around the entire perimeter of the laminated topper pad 102 as shown in FIG. 3. Corner portions 132 of the flap 130 are cut and sewn to form a skirt that hangs down over the side surfaces 134 of the mattress 108 like an apron as shown in FIGS. 4–6. Any suitable method may be used for securing the flap 130 to the protective cover 122—such as thermal bonding, gluing, sewing, etc. Alternatively, the protective cover 122 may be eliminated, and the flap 130 may be secured directly to the laminated topper pad 102 around its entire periphery. As shown in FIG. 6, the inside surface of the flap 130 may be releasably secured to the mattress 108 using Velcro pads 136. (Velcro is a registered trademark.) The attachment of the flap 130 to the mattress 108 keeps contaminants from getting into the pinhole-type perforations 126 in the bottom surface 124 of the laminated topper pad 102. The flap 130 also serves to keep patient fluids from getting between the laminated topper pad 102 and the mattress 108. Handle straps 138 are sewn on the inside of the flap 130, two on each side as shown in the area of the topper pad 102 that corresponds to the torso area of a patient. Preferably, the topper pad 102 may be made from radiolucent materials to allow the caregiver to shoot x-rays through the pad 102 without moving the patient off the pad 102.

In operation, to move a patient 104 from the first support surface 106 to the second support surface 112, the stretcher 110 is moved next to the hospital bed 116. The elevation of the two support surfaces 106, 112 is adjusted so that they are generally disposed side by side and in the same horizontal plane. Next, the flap 130 is flipped up to disengage the topper pad 102 from the mattress 108. The handle straps 138, which are normally on the inside of the flap 130 when the flap 130 is hanging down from the topper pad 102, are located on the outside of the flap 130 when the flap 130 is flipped up. The air blower 140 is turned on to pump a high volume of low pressure air (about 300 CFM at 1 PSI) into the laminated topper pad 102 to provide the lift needed to float the patient 104 on the mattress 108. Once the patient is floated, the caregiver stands across the bed 116 to which the patient is to be moved, grabs the handle straps 138 and pulls the patient 104 over onto the mattress 114 supported on the bed 116. The air bearing produced by the low pressure air escaping through the pinhole-type perforations 126 in the bottom surface 124 of the laminated topper pad 102 produces a low friction surface to facilitate the transfer of a patient from one support surface to another support surface. Additionally, the bottom surface 128 of the protective cover 122 may be provided with a low friction coating to further facilitate patient transfer. After the patient is moved to the second support surface 112, the blower 140 is turned off, the hose 142 is disconnected from the blower 140, and the patient is log rolled off the laminated topper pad 102 onto the second support surface 112. The topper pad 102 may then be returned to the stretcher 110 or stored for later use. If the topper pad 102 is returned to the stretcher 110, the hose 142 may be tucked under the mattress 108 so that it can be out of the way.

Air is preferably pumped into the foam pad 118, however any suitable fluid such as other gasses may be pumped into the foam pad 118 without exceeding the scope of the invention as presently perceived. Thus, throughout the specification and claims, the term "air" will be understood to mean any suitable fluid.

Referring to FIG. 3, illustrative dimensions of the foam pad assembly are as follows: the dimension "a" 37 inches (about 94 centimeters), the dimension "b" 22 inches (about 56 centimeters), the dimension "c" 8 inches (about 20 centimeters), the dimension "d" 75 inches (about 190 centimeters), the dimension "e" 9.5 inches (about 24 centimeters), the dimension "f" 26 inches (about 66 centimeters), the dimension "g" 16 inches (about 41 centimeters), the dimension "h" 3 inches (about 7 centimeters), the angle "I" 45 degrees, and the angle "j" 30 degrees. The diameter of pinhole-type perforations 126 is about 0.03 inch.

Illustrative specifications of some key components of the patient transfer apparatus 100 are as follows:

1) Foam pad 118—very light density foam pad (e.g., about 12 ILD), available from Cascade Designs, Inc.
2) Stain-resistant protective cover 122—Urethane coated fabric, such as "Dartex" available from Penn-Nyla, Inc.
3) Low friction coating on the bottom surface 128 of the cover 122—Taffeta nylon.
4) Handle straps 138—nylon.
5) Air blower 140—such as air blowers marketed by Hoover, Inc.
6) Hose 142—a nylon tube about 2 inches (about 5 centimeters) in diameter. The nylon tube may have a coating of urethane on the outside to facilitate joining of the tube to the lamination.

Figures 7, 8, 9, 10, 11:
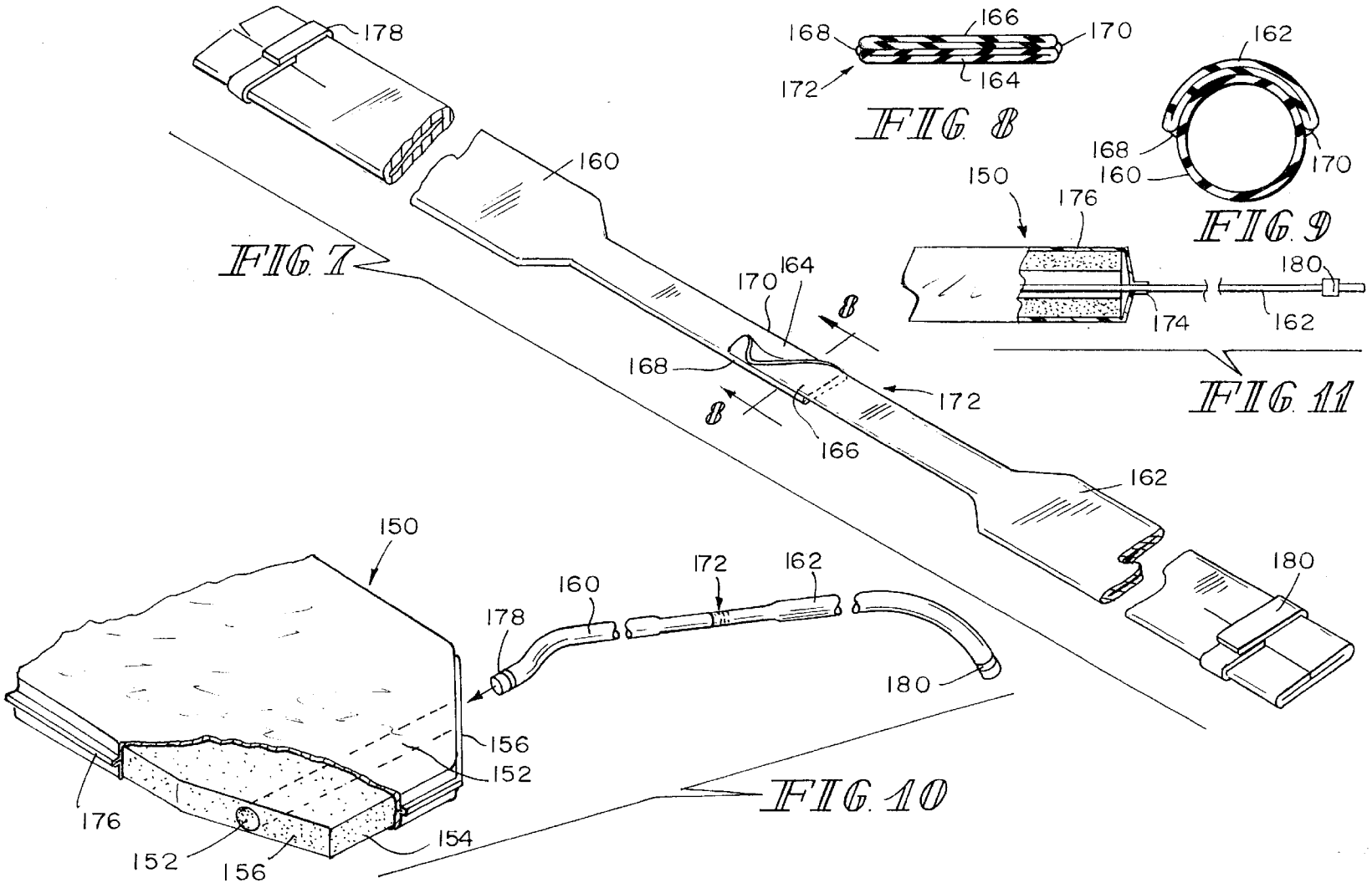
FIGS. 7–11 show an alternative method of hooking up the blower to the topper pad of FIGS. 1–6.

An alternative configuration for hooking up a blower to a topper pad 150 is shown in FIGS. 7–11. The topper pad 150, which is shown without lamination and protective cover in FIG. 10, is similar to the topper pad 102 shown in FIGS. 1–6. The topper pad 150 includes a through core hole 152 across angled corners 156 near a foot end 154 of the topper pad 150. As shown in FIG. 7, a pair of sealable fabric hoses 160, 162, which are normally flat, have overlapping end portions 164, 166. The overlapping end portions 164, 166 are joined along their longitudinal edges 168, 170 in the manner shown in FIG. 8 to form a joint 172. As shown in FIG. 9, when pressurized air is pumped into one of the two hoses 160, 162, the other of the two hoses 160, 162 closes up to prevent air from escaping through the other hose to the atmosphere. The hoses 160, 162 are fed through one end of the core hole 152 in the topper pad 150 in the manner shown in FIG. 10 until the overlapping joint 172 is centered with respect to the topper pad 150. The outer peripheries 174 of the hoses 160, 162 are sealed to the lamination 176 as shown in FIG. 11 to form air tight joints. Typically, the hoses 160, 162 are nylon tubes about 2 inches (about 5 centimeters) in diameter. The nylon tubes 160, 162 may have a coating of urethane on the outside to facilitate joining of the tubes 160, 162 to the lamination 176. Normally, the hoses 160, 162 are tucked under the mattress supporting the topper pad 150. The free ends of the hoses 160, 162 are each equipped with Velcro straps 178, 180. A Velcro strap associated with the hose to be hooked up to the blower is used to attach the hose to the blower. In operation, one of the two hoses 160, 162 is pulled out from under the mattress and hooked to the blower to pump high volume of low pressure air (about 300 CFM at 1 PSI) into the topper pad 150. Illustratively, the hoses 160, 162 are each about 72 inches long (about 183 centimeters), and the overlapping portions 164, 166 are each about 3 inches (about 8 centimeters) long.

Figures 12, 13, 14:
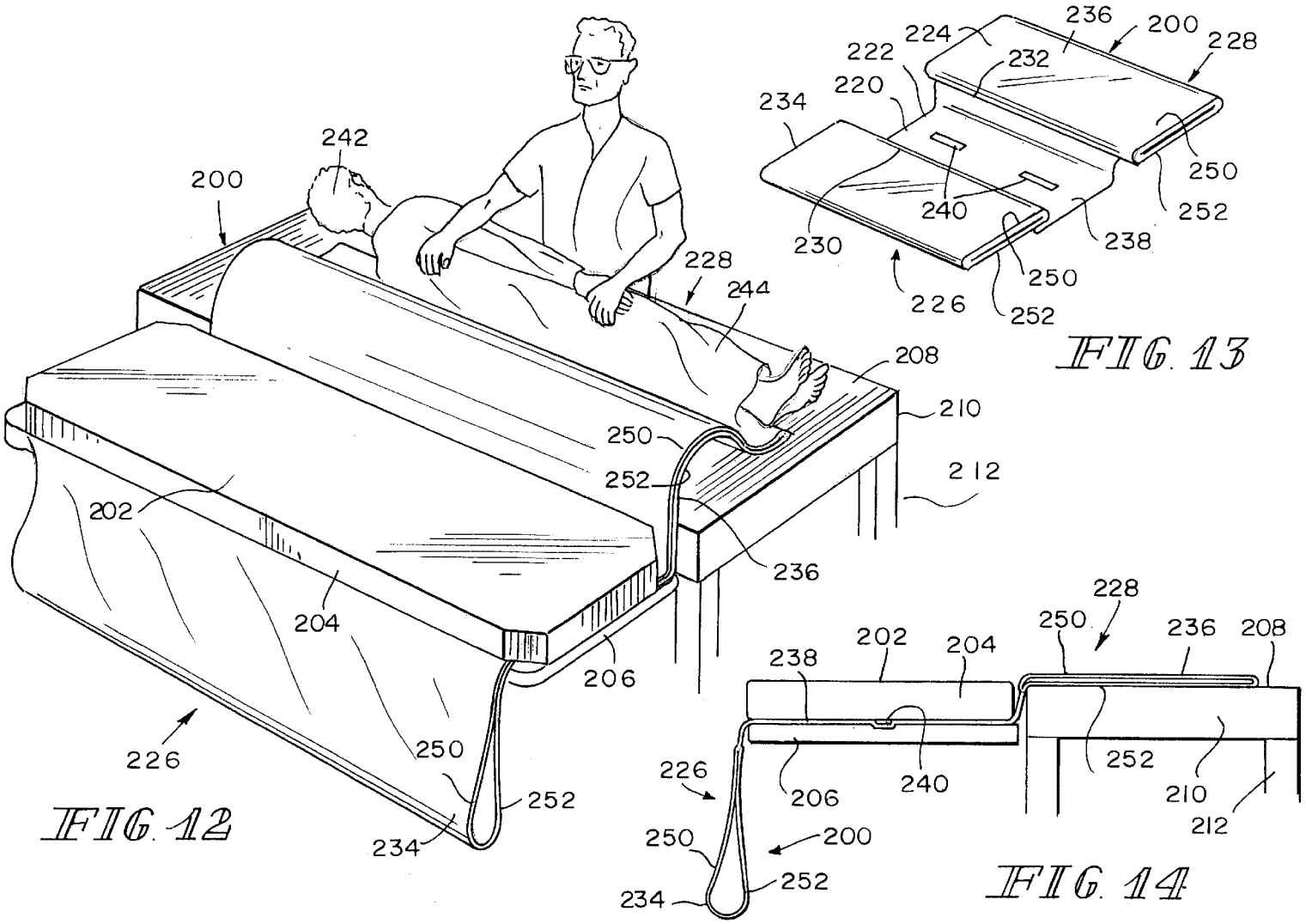
FIG. 12 shows a perspective view of a second embodiment of the patient transfer apparatus comprising a sheet of material with a low-friction, inner surface and a high friction outer surface that is folded over on both sides and bonded at the longitudinal edges thereof to create two rolling transfer tubes—one on each side of a middle portion which is releasably securable to a mattress supported on the middle portion, the transfer tubes being normally tucked under the mattress supported on the middle portion, the tubes permitting patient transfers to and from either side of the mattress.
FIG. 13 shows construction details of the transfer tubes of FIG. 12.
FIG. 14 is a view showing a mattress supported on the middle portion connecting the two oppositely-disposed transfer tubes, one of the transfer tubes hanging downwardly on one side of the middle portion and the other transfer tube laid flat on an adjacent support surface to which a patient is to be transferred.

A second embodiment 200 of the patient transfer device of the present invention is shown in FIGS. 12–14. The patient transfer apparatus 200 is suitable for transferring a patient 242 from a first support surface—such as a support surface 202 of a mattress 204 supported on a hospital stretcher 206, to a second support surface—such as a support surface 208 of a mattress 210 supported on an operating table 212. As best shown in FIG. 13, a stain-resistant piece of fabric 220 with relatively low friction on the inside surface 222 and relatively high friction on the outside surface 224 is folded over on two sides 226, 228, and bonded at the respective longitudinal edges 230, 232 to create two rolling transfer tubes 234, 236 on the opposite sides of a middle part 238. Any suitable means may be used for attaching the longitudinal edges 230, 232 to the middle part 238—such as, for example, heat sealing, sewing, gluing, etc. The mattress 204 is supported on the top side of the middle part 238. The middle part 238 is releasably secured to the underside of the mattress 204 as shown in FIG. 14. Any suitable means may be used for releasably securing the topside of the middle part 238 to the underside of the mattress 204—such as, for example, Velcro pads 240. This configuration of the device 200 provides rolling transfer tubes 234, 236 on both sides of the stretcher 206 for transfer to and from either side of the stretcher 206. The two rolling transfer tubes 234, 236 may be folded and tucked under the mattress 204 on the respective sides 226, 228 of the mattress 204 when not in use.

In operation, to move a patient 242 from the stretcher 206 to the operating table 212, the rolling transfer tube 236 on the side 228 of the stretcher 206 adjacent to the operating table 212 is pulled out from under the mattress 204, and the patient is log rolled to place the rolling transfer tube 236 and a draw sheet 244 under the patient 242. Next, the stretcher 206 is wheeled next to the operating table 212. The two support surfaces 202 and 208 of the stretcher 206 and the operating table 212 are adjusted to be side by side and in the same horizontal plane. The draw sheet 244 is then used to pull the patient 242 across the support surfaces 202 and 208 of the stretcher 206 and the operating table 212 respectively, while the rolling transfer tube 236 slides on itself to roll the patient 242 across the two support surfaces 202 and 208. When the patient transfer is complete, the rolling transfer tube 236 is tucked under the mattress 204 of the stretcher 206, much like a bed sheet is tucked under a bed. In like manner, the patient 242 can be moved to another support surface of a hospital bed or an x-ray table or a stretcher on the other side 226 of the stretcher 206 using the other rolling transfer tube 234.

It will be seen that the tubes 234, 236 are flattened when placed under a patient to have an upper run 250 of the relatively low friction surface facing downwardly to engage a lower run 252 of the relatively low friction surface facing upwardly such that the upper and lower runs 250, 252 can slide smoothly transversely as the patient is moved from a first support surface to a second support surface. The tubes 234, 236 are configured to be positioned on opposite sides 226, 228 of the first support surface 202 such that one of the tubes 234, 236 provides movement of the patient to and from one side 226 of the first support surface 202 and such that other of the tubes 234, 236 provides movement of the patient to and from the other side 228 of the first support surface 202.

Illustratively, the stain-resistant piece of fabric 220 is a nylon sheet, with Teflon or silicone coating on the inside surface 222. Alternatively, the inside surface 222 may be calendered to give it a more slippery surface on the inside than on the outside. The longitudinal dimension of each tube 234, 236 is about 46 inches (117 centimeters), and the width is about 26 inches (about 66 centimeters). Likewise, the longitudinal dimension of the middle part 238 is about 46 inches (117 centimeters), and the width is about 26 inches (about 66 centimeters).

Figure 15:
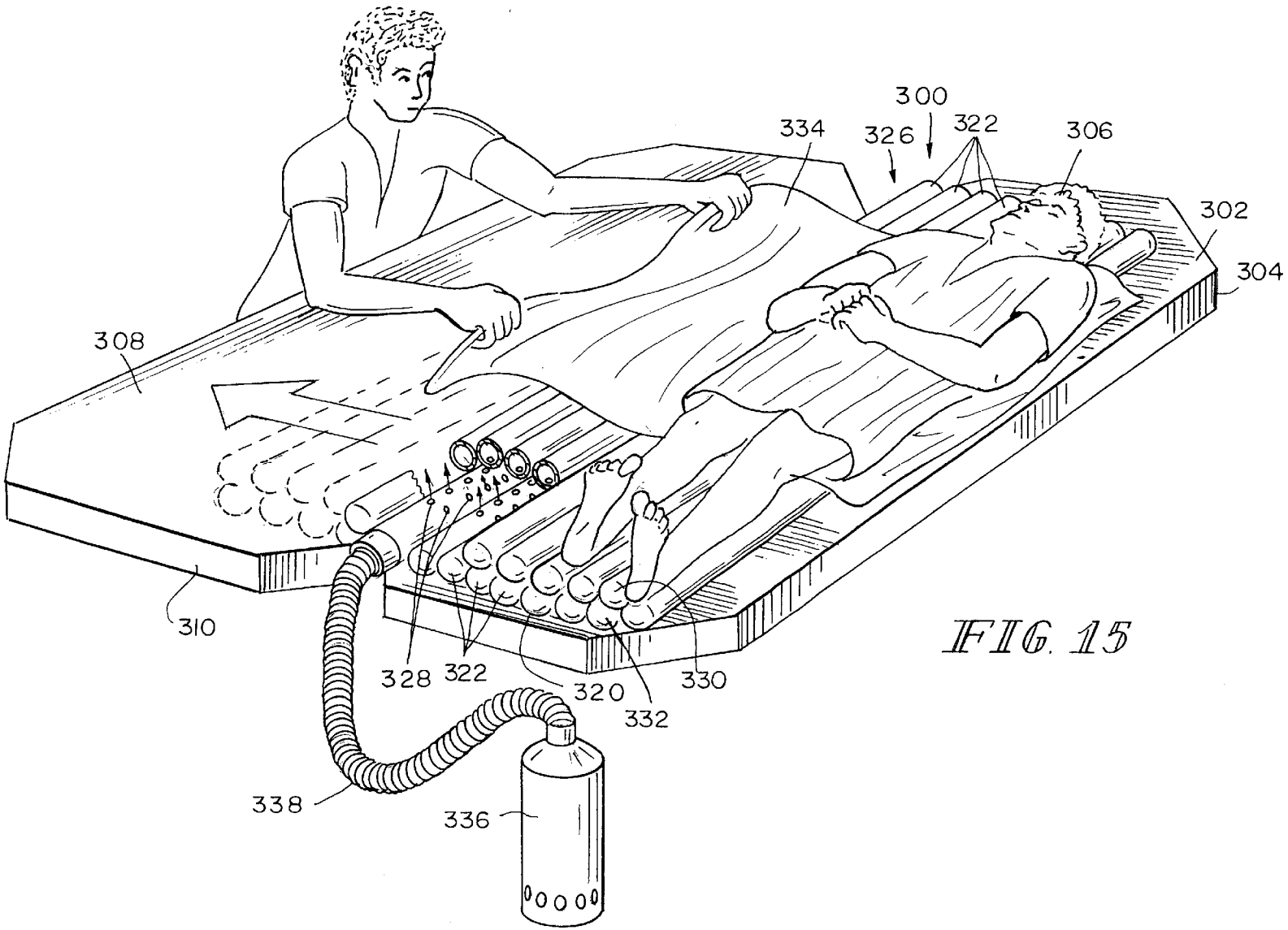
FIG. 15 shows a perspective view of a third embodiment of the patient transfer apparatus comprising a bladder with a plurality of longitudinally-extending and laterally spaced apart air chambers to receive air under pressure, the bladder is folded over and fastened together along its longitudinal side edges to form a rolling transfer tube, the tube being flattened when placed under a patient to have an upper run and a lower run in contact with each other, the upper run having pinhole-type perforations opening downwardly and the lower run having pinhole-type perforations facing upwardly to expel fluid under pressure to provide a fluid bearing in the space between the upper and lower runs to permit the transfer tube to roll easily.
Figure 16:
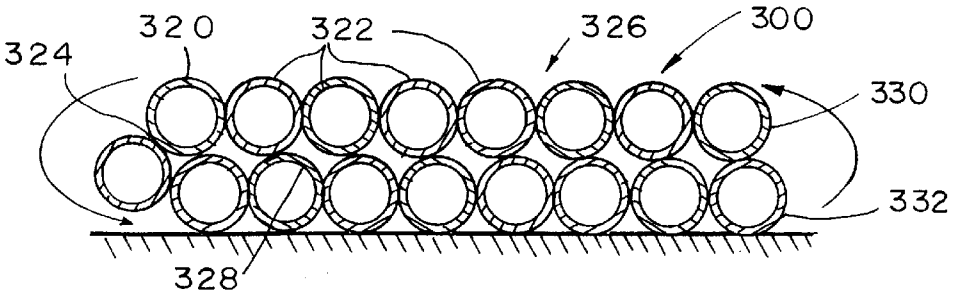
FIG. 16 shows a sectional view of the transfer tube of FIG. 15, FIG. 17 diagrammatically shows an alternative configuration of the rolling transfer tube of FIGS. 15 and 16 comprising a laminated foam pad that is folded over and joined along its longitudinally extending side edges to form a rolling transfer tube.

A third embodiment 300 of the patient transfer device of the present invention is shown in FIGS. 15 and 16. The patient transfer device 300 is suitable for transferring a patient 306 from a first support surface—such as a support surface 302 of a mattress 304 supported on a hospital stretcher (not shown), to a second support surface—such as a support surface 308 of a mattress 310 supported on an x-ray table (not shown). A bladder 320, having a plurality of longitudinally-extending and laterally spaced apart air chambers 322 to receive air under pressure, is folded over itself and fastened together along its longitudinal edges 324 to form a continuous and endless rolling transfer tube 326. Any suitable means may be used for joining the longitudinal edges 324 of the bladder 320—such as, for example, heat sealing. The tube 326 is flattened when placed under a patient to have an upper run 330 and a lower run 332 in contact with each other. As best seen in FIG. 15, the tube 326 has a wall structure with pinhole-type perforations 328 opening downwardly from the upper run 330 and upwardly from the lower run 332 to expel pressurized air inwardly.

In operation, the patient 306 is log rolled onto a draw sheet 334 and the tube 326. A blower 336 is coupled to the tube 326 to pump a high volume of low pressure air (about 300 CFM at 1 PSI) into the air chambers 322. The air escapes inwardly to develop a low friction air bearing in the space between the upper and lower runs 330, 332. The low friction air bearing allows the endless tube 326 to roll easily to move the patient 306 across the tube 326 from the first support surface 302 to the second support surface 308, similar to a roller board.

Air chambers 322 are preferably inflated and deflated using air, however any acceptable fluid such as other gasses can be used to inflate air chambers 322 without exceeding the scope of the invention as presently perceived. Thus, throughout the specification and claims such fluid will be referred to as air, although it is understood that other fluids may be used.

Illustratively, when flattened, the length of the tube 326 is about 46 inches (117 centimeters), the width is about 26 inches (about 66 centimeters) and the height is about 3 inches (about 8 centimeters). The diameter of the longitudinally extending air chambers 322 is about 1.5 inches (about 4 centimeters). The material for the bladders 322 is stain-resistant Nylon, with Teflon or silicone coating on the inside surface.

Figure 17:
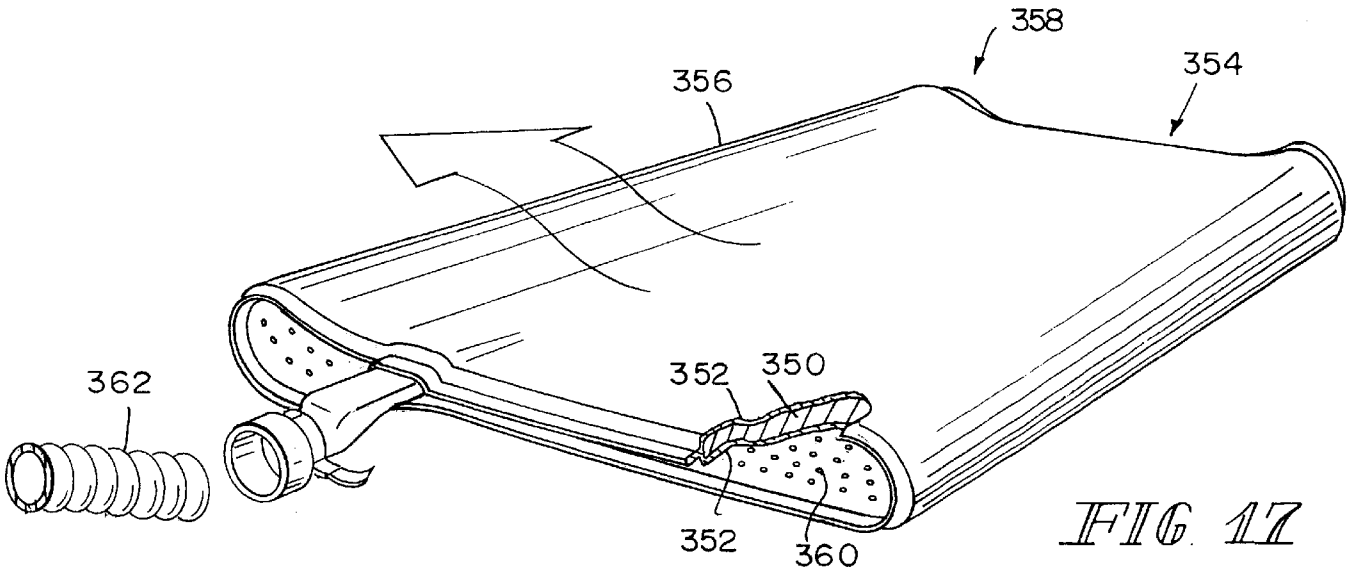
Figure 18:
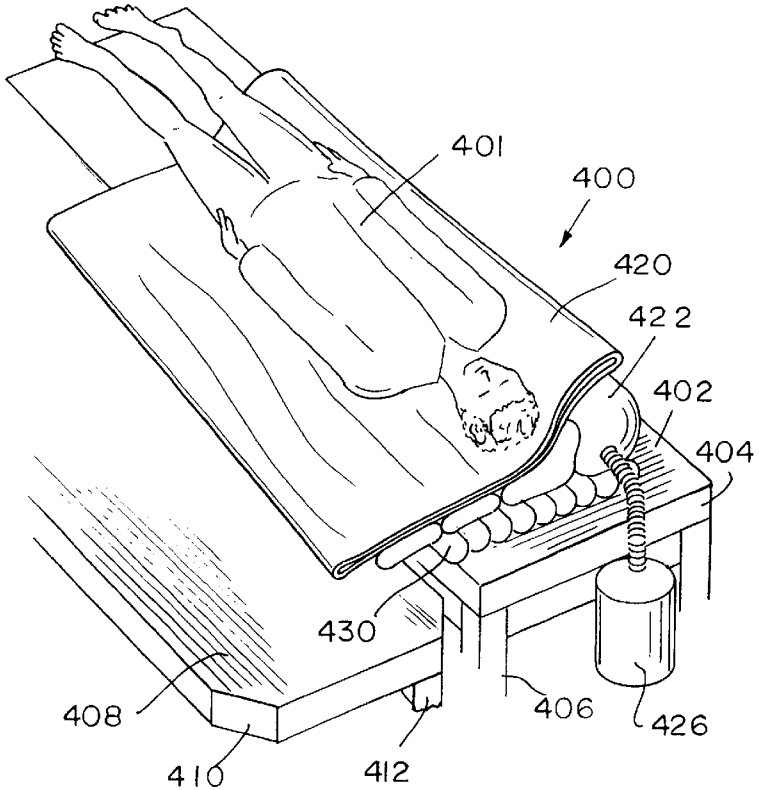
FIG. 18 shows a perspective view of a fourth embodiment of the patient transfer apparatus comprising a continuous loop rolling transfer sheet that lies on top of a first plurality of longitudinally-extending, laterally-spaced relatively large diameter bladders which are sequentially inflated to tilt and move the patient from a first support surface to a second support surface, the first set of relatively large diameter bladders being supported on a second plurality of longitudinally-extending, laterally-spaced relatively small diameter bladders.

Another method of construction of the roller board-type tube is shown in FIG. 17. As shown therein, a thin sheet 350 of porous foam pad is encapsulated in a lamination 352 to form a laminated foam pad 354. The foam pad 350 is laminated with material (such as Nylon) that is impervious to air. The laminated foam pad 354 is folded over itself and sealed along its longitudinal edges 356 to produce a rolling transfer tube 358, like the tube 326 in FIGS. 15 and 16. Any suitable means may be used for joining the longitudinal edges 356 of the foam pad 350—such as, for example, heat sealing. The inside surface of the rolling transfer tube 358 is provided with pinhole-type perforations 360 to create a low friction surface on the inside of the tube 358. An air inlet tube 362 is coupled to laminated foam pad 354 to pump high volume of low pressure air (about 300 CFM at 1 PSI) into the foam pad 354 to produce an air bearing on the inside of the tube 358. The operation of the rolling transfer tube 358 formed from the laminated foam pad 354 is like the operation of the rolling transfer tube 326 illustrated in FIGS. 15 and 16.

Illustratively, the laminated foam pad 342 is a very light density foam pad (e.g., about 12 ILD), available from Cascade Designs, Inc. When flattened, the length of the tube 358 is about 46 inches (117 centimeters), the width is about 26 inches (about 66 centimeters) and the height is about 1 inch (about 2.5 centimeters). The thickness of each run of the foam pad 350 is about ½ inches (about 1 centimeter).

Figure 19:
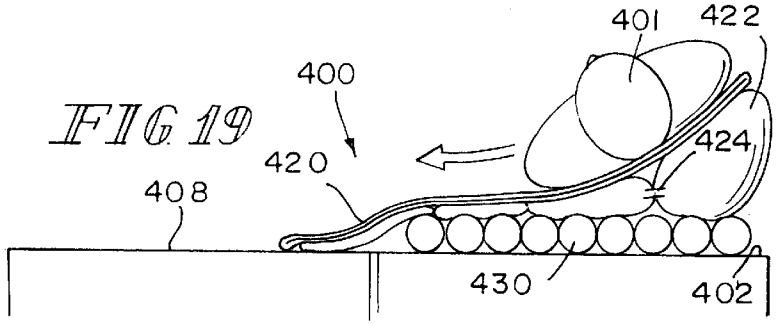
FIGS. 19–21 illustrate the operation of the rolling transfer sheet and sequentially inflated bladders of FIG. 18.
Figure 20:
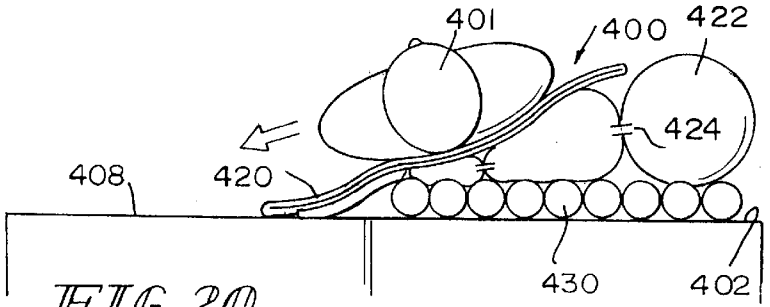
Figure 21:
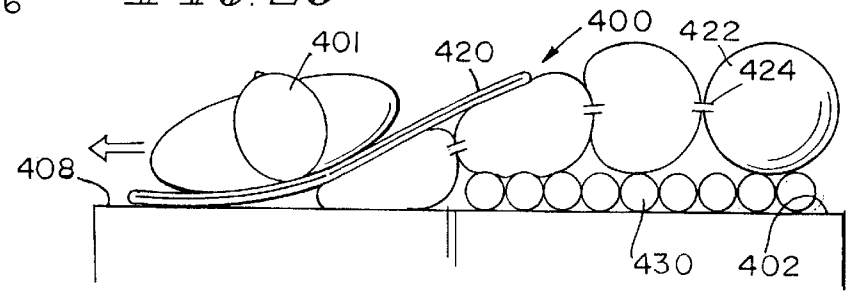

A fourth embodiment 400 of the patient transfer device of the present invention is shown in FIGS. 18–21. The patient transfer device 400 is suitable for transferring a patient 401 from one support surface—such as a support surface 402 of a mattress 404 supported on a hospital stretcher 406, to a second support surface—such as a support surface 408 of a mattress 410 supported on a hospital bed 412. This device includes a closed loop-rolling transfer sheet 420 that lies on top of a plurality of large diameter longitudinal bladders 422, which are sequentially inflated. The rolling transfer sheet 420 is attached to the last of the sequentially inflated bladders 422, and lays on top of the bladders 422. The longitudinal bladders 422 are laterally spaced, and bonded together along the longitudinal sides. Any suitable technique may be used to bond the bladders 422 along their longitudinal sides and to attach the rolling transfer sheet 420 to the last of the sequentially inflated bladders 422, such as heat sealing. Built into the seams between the bladders 422 are one-way "pop-off" valves 424 that allow air to pass through into the next sequential bladder 422 if the pressure is above 1 PSI. A high volume pump 426 (about 300 CFM) is hooked up to the first bladder 422 that is farthest away from the surface 408 to which the patient 401 is to be transferred to. When the pump is turned on, the first bladder 422 fills up to tilt the shoulder of the patient 401. It fills until the internal pressure builds to 1 PSI. Then the pop off valve opens, allowing the next sequential bladder 422 to fill, causing a pushing action on the back of the patient 401. Thus, the large bladders 422 sequentially inflate and tilt the patient as shown in FIGS. 19–21. The tilted surface moves across the support surface 402 of the stretcher 406 as the large bladders 422 are sequentially inflated, and the rolling transfer sheet 420 allows the patient 401 to roll sideways toward the second support surface 408 without assistance from a caregiver. Once the transfer takes place large plugs (1 inch or 2.5 centimeters) are opened in each bladder 422, and the air is allowed to escape to deflate the bladders 422. The large diameter bladders 422 may, in turn, be supported on a second plurality of air cushion bladders 430 to prevent the patient from sinking to an underlying hard support surface when the large bladders 422 are deflated or depressurized and the patient 401 is to be left on the device 400 for a long period of time. The small bladders 430 are, however, optional.

Illustratively, the length of the pad 400 is about 46 inches (117 centimeters) and the width is about 26 inches (about 66 centimeters). The diameter of the large bladders 422 is about 18 inches (about 46 centimeters), and the diameter of the small bladders 430 is about 2 inches (about 5 centimeters). The material for the bladders 422, 430 is stain-resistant Nylon, with Teflon or silicone coating on the outside. The rolling transfer sheet 420, when flattened, is at least 36 inches wide (at least 91 centimeters) and at least 42 inches long (about 107 centimeters). The rolling transfer sheet 420 is a pliable material like nylon that is slippery on the inside and frictional on the outside. The high volume low pressure pump is of the type marketed by Nilfisk, Model No. GSD115.

Figure 22:
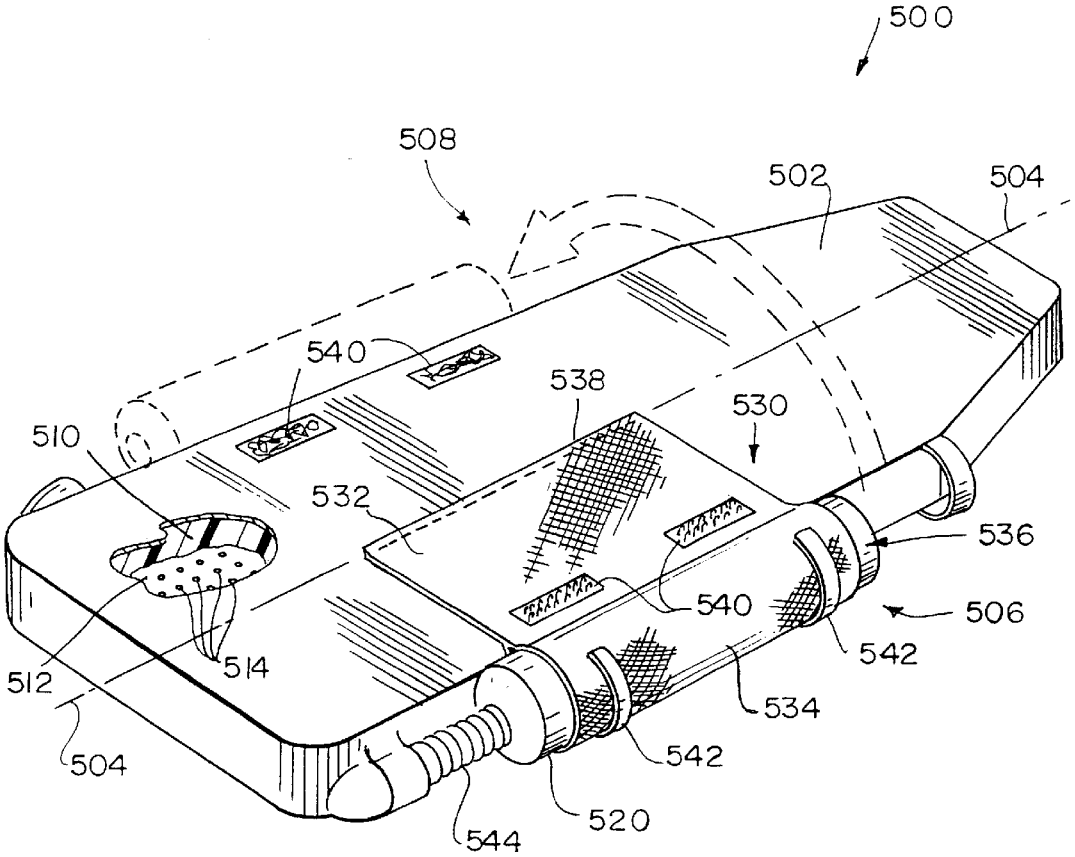
FIG. 22 shows a perspective view of a fifth embodiment of the patient transfer apparatus comprising a laminated foam pad that has a pouch for storing an air blower that can be positioned on either side of the laminated foam pad.

A fifth embodiment 500 of the patient transfer device of the present invention is shown in FIG. 22. The patient transfer device 500 includes a pad 502 having a longitudinal axis 504 and first and second sides 506 and 508. The pad 502 includes a fluid chamber 510 to receive fluid under pressure. The fluid chamber 510 has a bottom wall 512 including pinhole-type perforations 514 for expelling pressurized fluid against a support surface to provide a fluid bearing between the pad 502 and the support surface. The fluid bearing facilitates movement of the pad 502 and a patient supported thereon from a first support surface to a second support surface. The pad 502 may be an inflatable air bladder or a laminated foam pad 102 of the type disclosed in FIGS. 1–6. The device further includes a pump or blower 520 configured to be coupled to the pad 502 for pumping pressurized fluid into the fluid chamber 510 and a pouch 530 for supporting the blower 520.

The pouch 530 includes a transversely-extending first portion or flap 532 and a second portion 534 that loops around to form an enclosure 536 for storing the blower 520. The first portion 532 includes a longitudinal edge 538 secured to the topside of the pad 502 along the longitudinal axis 504. Any suitable means may be used for attaching the longitudinal edge 538 of the pouch 530 to the pad 502—such as heat sealing, sewing, gluing, etc. The transversely-extending first portion 532 is dimensioned so that the blower 520 can be positioned on either side 506, 508 of the pad 502, depending on which side of the pad 502 the patient is to be moved. For example, if the patient is to be moved to a support surface adjacent to the first side 506 of the pad 502, the blower 520 is positioned on the second side 508 of the pad 502. On the other hand, if the patient is to be moved to a support surface adjacent to the second side 508 of the pad 502, the blower 520 is positioned on the first side 506 of the pad 502. This arrangement keeps the blower 520 out of the way, provides balanced weight for transfer and keeps the pad 502 and the blower 520 together so that one part doesn't get lost. Any suitable means may be used for releasably securing the pouch 504 to the inflatable pad 502—such as Velcro strips 540.

The second portion 534 of the pouch 530 supporting the blower 520 is provided with handle loops 542 which can be grabbed by the caregiver to pull the pad 502 and a patient supported thereon across the support surfaces. The blower 520 may be energized by using a power cord or a battery (not shown). An air inlet tube 544, which is detachable, couples the blower 520 to the pad 502. The blower 520 may be removed from the pouch 530 for laundering the pad 502. The length of the pad 502 is about 46 inches (117 centimeters), the width is about 26 inches (about 66 centimeters) and the height is about 1 inch (about 2.5 centimeters).

Although the present invention has been described in detail with reference to certain preferred embodiments, variations and modifications exist within the scope and spirit of the present invention as described above.

What is claimed is:

1. A transfer device for moving a patient from a first support surface to a second support surface placed alongside the first support surface, the transfer device comprising a foam pad and a fluid impervious enclosure surrounding the foam pad, the foam pad occupying at least a majority of an interior region defined by the enclosure, the transfer device being configured to be placed under the patient on the first support surface and extending along at least a portion of the patient's body, the foam pad receiving fluid under pressure, the enclosure having a bottom wall facing the first support surface, the bottom wall having perforations for releasing pressurized fluid from the foam pad against the first support surface to provide a fluid bearing between the bottom wall and the first support surface to facilitate moving the transfer device and the patient supported thereon from the first support surface to the second support surface.

2. The transfer device of claim 1, wherein the fluid is air and wherein the air is expelled from the bottom wall against the first support surface to provide an air bearing.

3. The transfer device of claim 2, further including a blower for pumping a relatively high volume of relatively low pressure air into the foam pad.

4. The transfer device of claim 3, further including a sealable fabric hose coupled to the blower and configured to be coupled to the foam pad on either side thereof.

5. The transfer device of claim 1, wherein the perforations comprise pinhole-type perforations.

6. The transfer device of claim 1, where the foam pad enclosure comprises a lamination.

7. The transfer device of claim 1, further including a protective cover K for enclosing the foam pad.

8. The transfer device of claim 7, wherein the protective cover is stain resistant.

9. The transfer device of claim 7, wherein the protective cover is fluid impervious.

10. The transfer device of claim 7, wherein the protective cover has a low friction bottom surface.

11. The transfer device of claim 7, wherein the foam pad, the enclosure and the protective cover are all made from radiolucent material.

12. The transfer device of claim 1, wherein the foam pad and the enclosure are both made from radiolucent material.

13. The transfer device of claim 1, wherein the perforations in the bottom wall of the enclosure have a higher density in the area of the foam pad that corresponds to a patient's torso.

14. The transfer device of claim 1, wherein the foam pad is made from a light density foam material.

15. The transfer device of claim 1, further including a flap coupled to the perimeter of the foam pad enclosure, wherein a rim portion of the flap is configured to hang down over side surfaces of the first support surface.

16. The transfer device of claim 15, wherein the flap is coupled to the perimeter of the foam pad enclosure by thermal bonding.

17. The transfer device of claim 15, further including a fastener configured to releasably couple the rim portion of the flap to the side surfaces of the first support surface.

18. The transfer device of claim 15, wherein the rim portion of the flap is configured to hang down over side surfaces of a mattress supported on the first support surface.

19. The transfer device of claim 18, further including a fastener configured to releasably couple the rim portion of the flap to the side surfaces of the mattress.

20. The transfer device of claim 15, further including a handle strap coupled to the rim portion of the flap.

21. A transfer device for moving a patient from a first support surface to a second support surface placed alongside the first support surface, the transfer device comprising a foam pad and a fluid impervious enclosure surrounding the foam pad, the foam pad occupying at least a majority of an interior region defined by the enclosure, the transfer device being configured to be placed under the patient on the first support surface and extending along at least a portion of the patient's body, the foam pad receiving fluid under pressure, the enclosure having perforations configured to expel pressurized fluid against the first support surface to provide a fluid bearing between the transfer device and the first support surface to facilitate moving the transfer device and the patient supported thereon from the first support surface to the second support surface.

22. The transfer device of claim 21, wherein the fluid is air, and wherein the air is released through the perforations in the enclosure against the first support surface to provide an air bearing.

23. A transfer device for moving a patient from a first support surface to a second support surface placed alongside the first support surface, the transfer device comprising:

a foam pad, and a perforated layer under the pad, the foam pad being connectable to a source of pressurized fluid such that the pressurized fluid from the source is moved through the foam pad, at least some of the pressurized fluid exits from the foam pad and moves through the perforated layer to provide a fluid bearing between the perforated layer and the first support surface to facilitate moving the transfer device and the patient supported thereon from the first support surface to the second support surface, the perforated layer remaining in contact with the foam pad when the pressurized fluid moves through the foam pad and the perforated layer.

24. The transfer device of claim 23, wherein the source is a pump, and the pressurized fluid is pumped through the foam pad.

25. The transfer device of claim 23, wherein the source is a blower, and the pressurized fluid is blown through the foam pad.

* * * * *